US012434109B2

(12) United States Patent
Elser

(10) Patent No.: US 12,434,109 B2
(45) Date of Patent: Oct. 7, 2025

(54) GOLF CLUB HEAD WITH ALIGNMENT STRUCTURE, AND GOLF CLUB INCLUDING SAME

(71) Applicant: DICK'S Sporting Goods, Inc., Coraopolis, PA (US)

(72) Inventor: Simon Elser, Coraopolis, PA (US)

(73) Assignee: Dick's Sporting Goods, Inc., Coraopolis, PA (US)

( * ) Notice: Subject to any disclaimer, the term of this patent is extended or adjusted under 35 U.S.C. 154(b) by 134 days.

(21) Appl. No.: 18/194,925

(22) Filed: Apr. 3, 2023

(65) Prior Publication Data

US 2024/0325830 A1 Oct. 3, 2024

(51) Int. Cl.
*A63B 53/04* (2015.01)
*A63B 53/00* (2015.01)
*A63B 69/36* (2006.01)

(52) U.S. Cl.
CPC ..... *A63B 53/0441* (2020.08); *A63B 53/007* (2013.01); *A63B 69/3685* (2013.01)

(58) Field of Classification Search
CPC ..... A63B 53/0441; A63B 53/0487; A63B 53/065; A63B 69/3676; A63B 69/3685; A63B 53/007
USPC ..... 473/251–254, 313–314, 340–341; D21/742–746
See application file for complete search history.

(56) References Cited

U.S. PATENT DOCUMENTS 4,712,797 A 12/1987 Kovalchek
5,167,414 A * 12/1992 Montgomery, III ..... A63B 53/0487 473/251
5,174,573 A 12/1992 Desbiolles et al.
D399,274 S * 10/1998 Bradford ..... D21/736
5,997,415 A 12/1999 Wood
6,080,070 A * 6/2000 Whitley ..... A63B 60/52 473/328
6,261,190 B1 7/2001 Ashcraft
6,743,112 B2 6/2004 Nelson
D509,867 S 9/2005 Perry
D515,646 S 2/2006 Perry
D531,242 S * 10/2006 Adams ..... D21/746
7,163,469 B2 * 1/2007 Bonneau ..... A63B 60/02 473/340
7,393,285 B2 7/2008 Stellander
7,407,443 B2 8/2008 Franklin et al.
7,485,047 B2 2/2009 Evans
D595,370 S 6/2009 Ines et al.
(Continued)

OTHER PUBLICATIONS

Notice of Allowance on U.S. Appl. No. 29/873,544 DTD Sep. 11, 2024.

*Primary Examiner* — Sebastiano Passaniti
(74) *Attorney, Agent, or Firm* — Foley & Lardner LLP

(57) ABSTRACT

The present disclosure relates to a golf club head having a body with a striking face that faces a front direction, and a plurality of elements that extend from the body toward a rear direction and that form an aperture. The aperture has a boundary with a geometric shape that is symmetric about a centerline that extends from the body toward the rear direction. The elements may include a first portion and a second portion, one of which is positioned above the other. The aperture extends through the first and second portions. A first part of the boundary is formed by the upper portion, and a second part of the boundary is formed by the lower portion.

18 Claims, 12 Drawing Sheets

(56) References Cited

U.S. PATENT DOCUMENTS

| | | | | |
|---|---|---|---|---|
| D600,295 | S | 9/2009 | Meeks | |
| 7,670,232 | B2 | 3/2010 | Franklin et al. | |
| 7,722,478 | B2 * | 5/2010 | Ebner | A63B 60/02 473/340 |
| 7,766,762 | B2 * | 8/2010 | Stellander | A63B 53/0487 473/254 |
| D623,710 | S | 9/2010 | Hilton et al. | |
| 7,803,066 | B2 | 9/2010 | Solheim | |
| 7,815,515 | B1 * | 10/2010 | Hunt | A63B 53/0487 473/340 |
| D627,840 | S | 11/2010 | Cameron | |
| 7,867,104 | B2 | 1/2011 | Franklin et al. | |
| 7,905,793 | B2 | 3/2011 | O'Neill | |
| D638,891 | S | 5/2011 | Nicolette et al. | |
| D639,361 | S | 6/2011 | Reinberg | |
| D639,366 | S | 6/2011 | Reinberg | |
| D639,367 | S | 6/2011 | Reinberg | |
| D645,104 | S | 9/2011 | Nicolette et al. | |
| 8,100,779 | B2 | 1/2012 | Solheim et al. | |
| 8,109,838 | B2 | 2/2012 | Solheim et al. | |
| 8,128,505 | B2 | 3/2012 | Tryner | |
| 8,246,481 | B2 | 8/2012 | Stites et al. | |
| 8,303,434 | B1 | 11/2012 | Depaul | |
| 8,382,605 | B2 * | 2/2013 | Treadwell | A63B 53/02 473/340 |
| 8,382,606 | B2 | 2/2013 | Franklin et al. | |
| 8,414,413 | B2 | 4/2013 | Franklin et al. | |
| 8,480,504 | B2 | 7/2013 | Hilton et al. | |
| 8,517,852 | B1 | 8/2013 | Hilton et al. | |
| 8,550,931 | B1 | 10/2013 | Hilton et al. | |
| D701,928 | S | 4/2014 | Cameron | |
| 8,696,483 | B2 | 4/2014 | Hilton | |
| D720,410 | S | 12/2014 | Brandt | |
| 8,900,064 | B2 | 12/2014 | Franklin | |
| 9,095,759 | B2 | 8/2015 | Hilton et al. | |
| 9,144,717 | B2 | 9/2015 | Franklin et al. | |
| 9,333,410 | B1 | 5/2016 | Myers | |
| D758,513 | S | 6/2016 | Cameron | |
| 9,375,615 | B2 | 6/2016 | Park | |
| 9,415,279 | B2 | 8/2016 | Foster | |
| 9,440,125 | B1 | 9/2016 | Myers | |
| D783,745 | S | 4/2017 | Chen | |
| 9,662,544 | B2 | 5/2017 | Foster | |
| 9,717,961 | B2 | 8/2017 | Cameron | |
| D801,458 | S | 10/2017 | Rollinson | |
| 9,844,716 | B2 | 12/2017 | Foster | |
| 9,873,027 | B2 | 1/2018 | Hamada | |
| D809,616 | S | 2/2018 | Toulon et al. | |
| D827,064 | S | 8/2018 | Wypych et al. | |
| 10,124,220 | B2 | 11/2018 | Cameron | |
| D844,085 | S | 3/2019 | Nicolette | |
| D844,723 | S | 4/2019 | Nicolette | |
| 10,293,237 | B1 | 5/2019 | Hilton et al. | |
| 10,363,464 | B2 | 7/2019 | Cameron | |
| D860,350 | S | 9/2019 | Rollinson | |
| D860,354 | S | 9/2019 | Rollinson et al. | |
| D861,091 | S | 9/2019 | Glorioso | |
| 10,532,264 | B2 | 1/2020 | Paster | |
| D877,831 | S | 3/2020 | Cameron | |
| 10,583,344 | B2 | 3/2020 | Hilton et al. | |
| 10,716,990 | B2 | 7/2020 | Hilton et al. | |
| D892,243 | S | 8/2020 | Rollinson et al. | |
| D907,730 | S | 1/2021 | Rollinson et al. | |
| D909,504 | S | 2/2021 | Schweigert et al. | |
| 10,960,286 | B2 | 3/2021 | Paster | |
| 11,020,640 | B2 * | 6/2021 | Higdon | A63B 53/042 |
| D924,993 | S | 7/2021 | Rollinson et al. | |
| D924,994 | S | 7/2021 | Rollinson et al. | |
| D924,995 | S | 7/2021 | Rollinson et al. | |
| D925,678 | S | 7/2021 | Cameron | |
| D933,765 | S | 10/2021 | Toulon et al. | |
| D934,969 | S | 11/2021 | Toulon et al. | |
| D943,694 | S | 2/2022 | Price et al. | |
| D943,695 | S | 2/2022 | Price et al. | |
| D944,348 | S | 2/2022 | Kim et al. | |
| D945,542 | S | 3/2022 | Andrews | |
| 11,420,100 | B2 | 8/2022 | Wang et al. | |
| D966,449 | S | 10/2022 | Bruschi et al. | |
| 11,707,656 | B2 * | 7/2023 | Scott | A63B 53/0487 473/340 |
| D994,808 | S | 8/2023 | Cameron | |
| D998,073 | S | 9/2023 | Andrews | |
| D998,734 | S | 9/2023 | Andrews | |
| 2003/0013546 | A1 * | 1/2003 | Bradford | A63B 60/02 473/341 |
| 2005/0075185 | A1 | 4/2005 | Green | |
| 2005/0239574 | A1 * | 10/2005 | Rohrer | A63B 60/02 473/340 |
| 2006/0068928 | A1 | 3/2006 | Nagy | |
| 2006/0094522 | A1 * | 5/2006 | Tang | A63B 53/0487 473/340 |
| 2006/0148585 | A1 * | 7/2006 | Vinton | A63B 53/0487 473/340 |
| 2008/0096682 | A1 | 4/2008 | Fox | |
| 2008/0176672 | A1 * | 7/2008 | Roach | A63B 60/02 473/340 |
| 2008/0261718 | A1 * | 10/2008 | O'Neill | A63B 60/00 473/340 |
| 2009/0017934 | A1 | 1/2009 | Stites et al. | |
| 2010/0113182 | A1 | 5/2010 | Franklin et al. | |
| 2010/0167836 | A1 * | 7/2010 | Horii | A63B 53/065 473/340 |
| 2010/0304878 | A1 | 12/2010 | Reichow et al. | |
| 2011/0151996 | A1 * | 6/2011 | Dewhurst | A63B 60/00 473/329 |
| 2012/0129620 | A1 | 5/2012 | Davis | |
| 2013/0337932 | A1 * | 12/2013 | Kammerer | A63B 53/0487 473/251 |
| 2014/0179456 | A1 * | 6/2014 | Hilton | A63B 53/0487 473/252 |
| 2015/0335966 | A1 | 11/2015 | Cameron | |
| 2016/0361611 | A1 | 12/2016 | Cameron | |
| 2018/0264332 | A1 | 9/2018 | Cameron | |
| 2020/0009432 | A1 | 1/2020 | Becktor et al. | |
| 2021/0339098 | A1 | 11/2021 | Scott et al. | |
| 2022/0152464 | A1 | 5/2022 | Pedraza | |
| 2022/0305350 | A1 | 9/2022 | Feheley | |
| 2022/0401803 | A1 | 12/2022 | Wang et al. | |

* cited by examiner

GOLF CLUB HEAD WITH ALIGNMENT STRUCTURE, AND GOLF CLUB INCLUDING SAME

FIELD

The present disclosure generally relates to a golf club head.

BACKGROUND

In the game of golf, alignment of the head of the golf club is critical. A golfer must ensure that the club head is aligned with respect to the ball, and oriented properly with respect to the ground for consistent shot placement. Without consistent alignment from shot to shot, the head of the club will not consistently strike the golf ball at the center of the ball, and a golfer's accuracy will suffer.

Some existing clubs have alignment marks imprinted or otherwise placed on them to provide a visual aid that helps the golfer align the club to the bal. However, these mere marks can be difficult to use and line up properly in a quick, repeatable, and efficient manner.

A club with an alignment feature that is easy to use and easy for a user to quickly determine whether the club is properly oriented and aligned to the ball is desirable. Accordingly, a golf club having an alignment feature that is easy and quick to visually evaluate can provide significant advantages and can also reduce or eliminate one or more of the foregoing challenges.

SUMMARY

The present disclosure relates to a golf club head having a body with a striking face that faces a front direction, and a plurality of elements that extend from the body toward a rear direction and that form an aperture. The aperture has a boundary with a geometric shape that is symmetric about a centerline that extends from the body toward the rear direction.

In some embodiments, the elements may include a first portion and a second portion, one of which is positioned above the other. The aperture extends through the first and second portions. A first part of the boundary is formed by the upper portion, and a second part of the boundary is formed by the lower portion. Optionally, the boundary may be a closed boundary. Optionally, the first portion and the second portion are at least partially separated by a gap.

Optionally, the first portion may include a first indexing line, the second portion may include a second indexing line, and each of the first and second indexing lines are perpendicular to the striking face of the striking portion and are co-linear when viewed from a position directly above the golf club head.

Optionally, the aperture defines a gap between the co-linear first and second indexing lines.

In any of the embodiments described above, the first portion and the second portion may be cantilevered off the body.

In any of the embodiments above, the first portion and the second portion may be at least partially fixed relative to one another by at least one of: a fastener, a spacer, or an integrated support.

In any of the embodiments above, the first portion or the second portion may have a surface that is substantially perpendicular to the striking face.

In any of the embodiments above, the geometric shape may have at least four sides.

In any of the embodiments above, a first part of the geometric shape may include a first set of two of the sides and a second part of the geometric shape includes a second set of two of the sides.

In any of the embodiments above, the geometric shape may be a diamond.

In another aspect, a golf club includes a shaft and a club head that is connected to the shaft. The club head comprises a body comprising a striking face that faces a front direction, and a plurality of elements that extend from the body toward a rear direction, and that form an aperture having a boundary with a geometric shape that is symmetric about a centerline that extends from the body toward the rear direction. Optionally, the geometric shape is a diamond. Optionally, the plurality of elements comprise a first portion a second portion, wherein: (i) one of the first portion and the second portion is positioned above the other of the first portion and the second portion; (ii) the aperture extends through the upper portion and the lower portion; and (iii) a first part of the boundary of the aperture is formed by the upper portion, and a second part of the boundary of the aperture is formed by the lower portion. Optionally, the first portion includes a first indexing line, the second portion includes a second indexing line, and each of the first and second indexing lines are perpendicular to the striking face of the striking portion and are co-linear when viewed from a position directly above the golf club head. Optionally, the aperture defines a gap between the co-linear first and second indexing lines. Optionally, the first portion and the second portion are cantilevered off the body. Optionally, the first portion and the second portion are at least partially separated by a gap. Optionally, at least one of the first portion or the second portion has a surface that is substantially perpendicular to the striking face.

BRIEF DESCRIPTION OF THE DRAWINGS

The accompanying drawings, which are incorporated into this document and constitute part of this specification, are illustrative of particular embodiments of the present disclosure and do not limit the scope of the present disclosure. The drawings are not to scale and are intended for use in conjunction with the explanations in the following detailed description.

DETAILED DESCRIPTION

Figure 1:
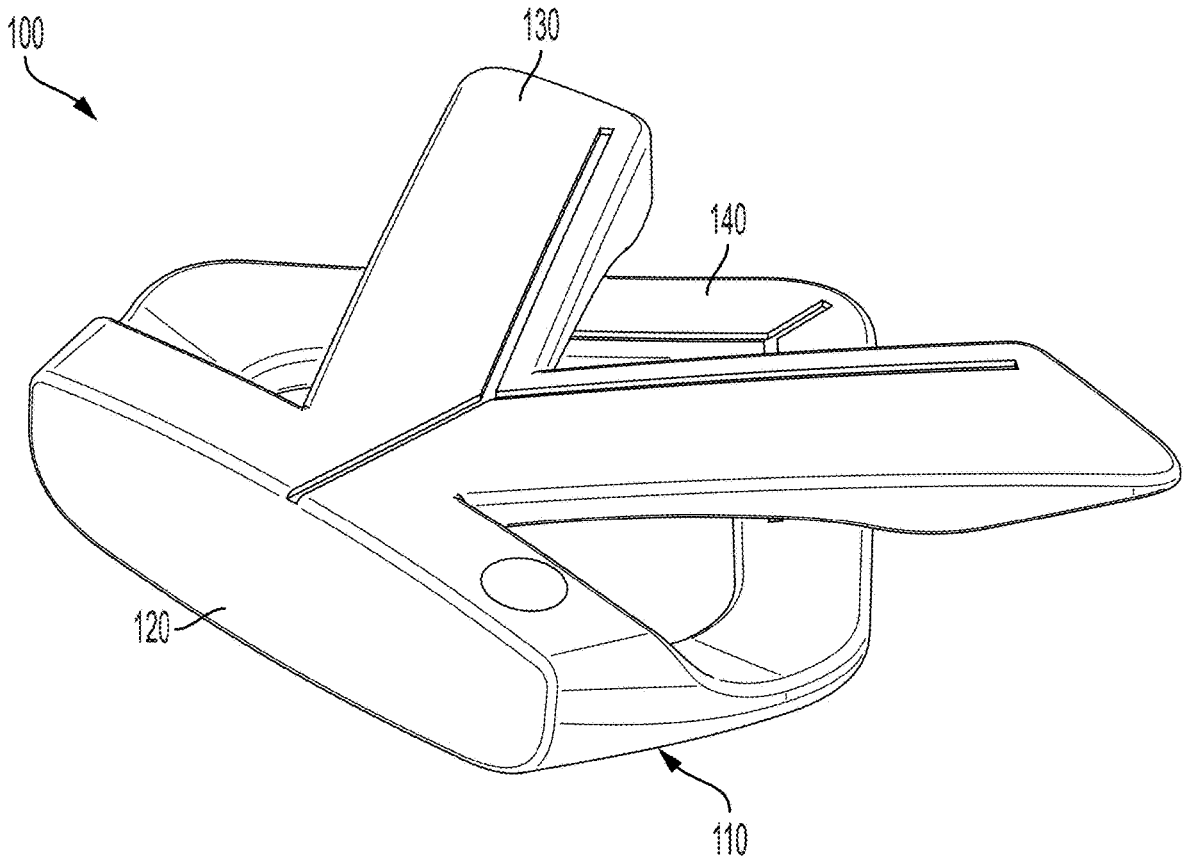
FIG. 1 is a perspective view of an example golf club head, consistent with disclosed embodiments.
Figure 2:
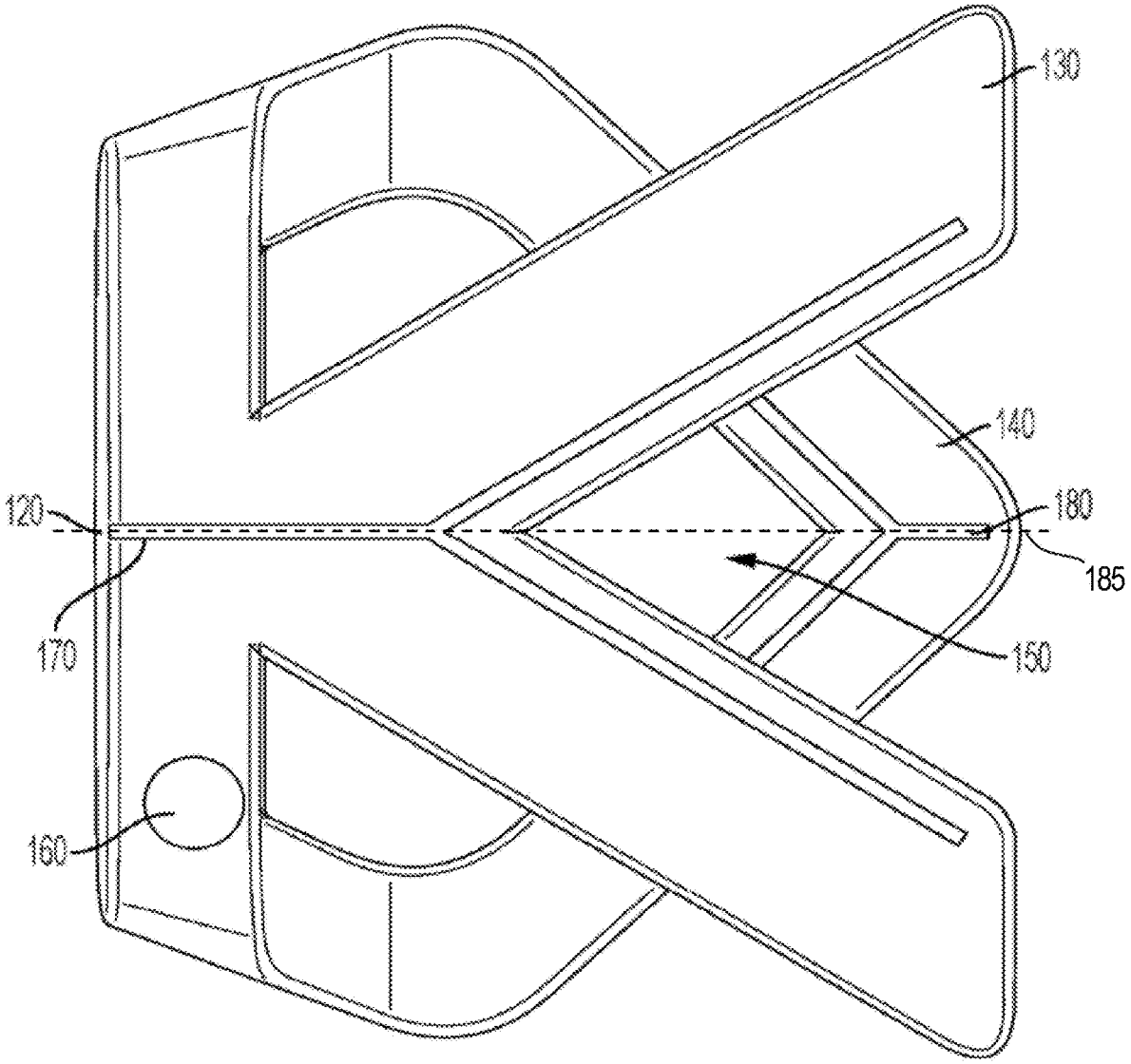
FIG. 2 is a top view of an example golf club head, consistent with disclosed embodiments.
Figure 3:
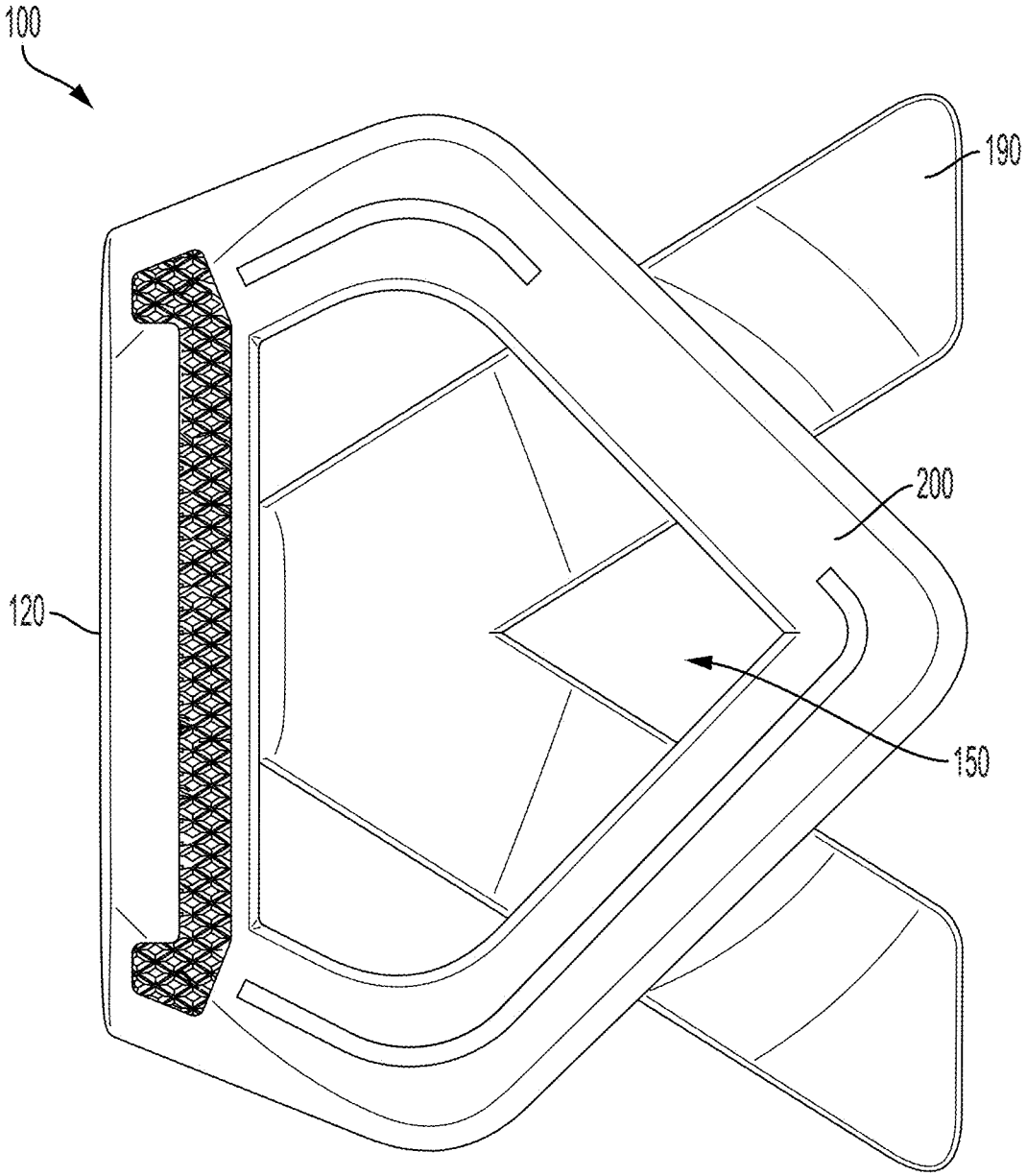
FIG. 3 is a bottom view of an example golf club head, consistent with disclosed embodiments.

The following discussion omits or only briefly describes conventional features of the disclosed technology that are apparent to those skilled in the art. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the instant invention, in combination with routine experiments, to achieve other outcomes not specifically disclosed in the examples or the embodiments.

Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meaning as commonly understood by one of ordinary skill in the art in the field of the disclosed technology. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Additionally, methods, equipment, and materials similar or equivalent to those described herein can also be used in the practice or testing of the disclosed technology.

The devices of the present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

It is also understood that all spatial references, such as, for example, proximal, distal, horizontal, vertical, top, upper, lower, bottom, left and right, are for illustrative purposes only and can be varied within the scope of the disclosure. For example, references such as "upper" and "lower", "up" and "down", "top" and "bottom", or "front" and "rear" are relative and used only in the context to the other.

In this document, when terms such as "first" and "second" are used to modify a noun, such use is simply intended to distinguish one item from another, and is not intended to require a sequential order unless specifically stated.

Various examples of the disclosed technology are provided throughout this disclosure. The use of these examples is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

The present disclosure relates to head for a golf putter for striking golf balls. Referring to FIG. 1, the club head 100 can have a body or striking portion 110 with an upper portion and a lower portion. An aperture forming a geometric shape extends through both the upper and lower portions. The upper and lower portions are at least partially separated by a distance sufficient to cause apparent visual deformation of the geometric shape when the shape is viewed at an angle by the user whose eyes are positioned above the club head 100 (i.e., from a position directly above the head 100). In this way, the user can determine if he or she has properly aligned the putter. If the shape appears to the user to be undeformed, the putter is properly aligned. Conversely, if the shape appears to the user to be deformed, the putter is not properly aligned, and the user should correct alignment before hitting the golf ball.

Figure 4:
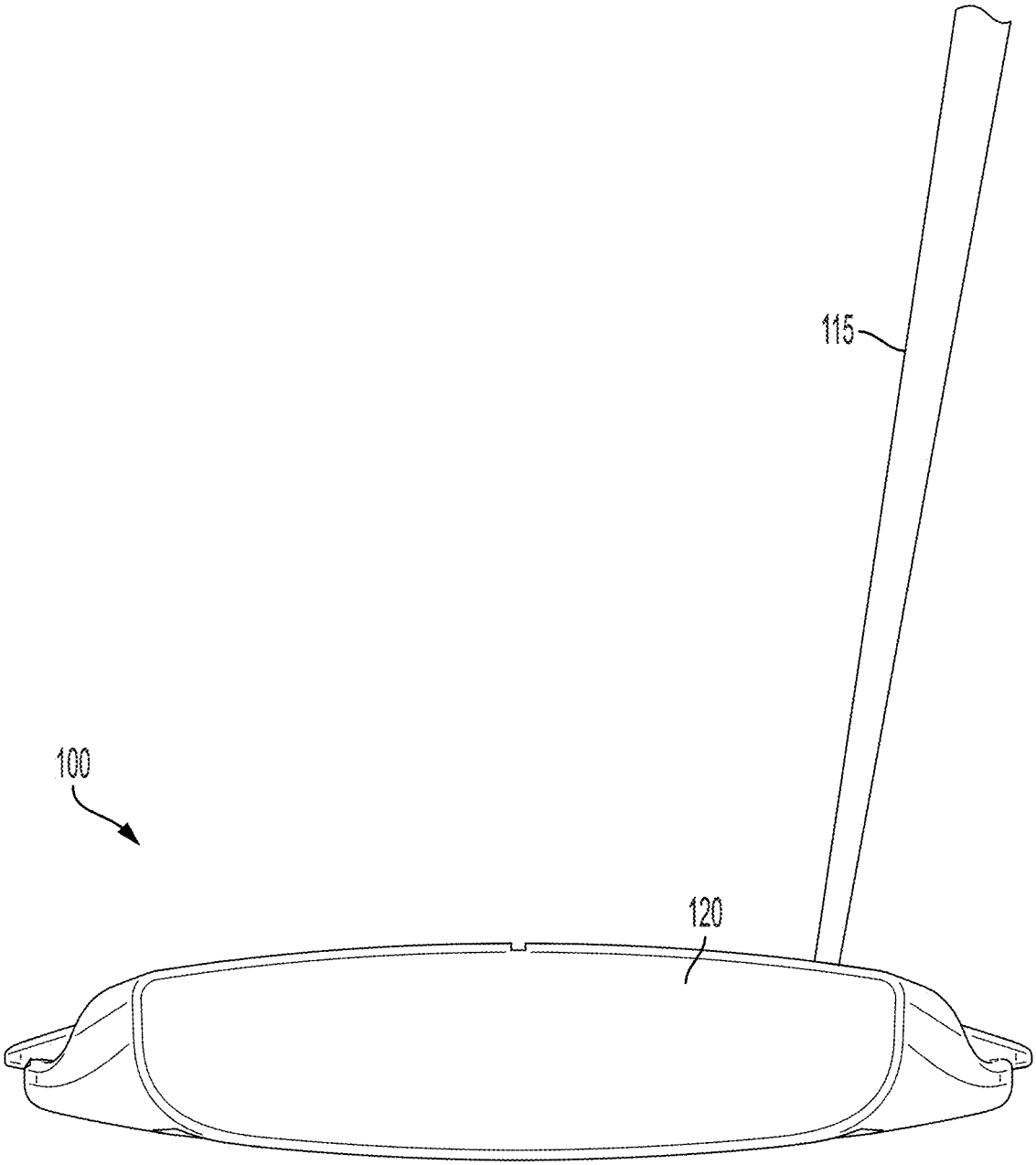
FIG. 4 is a front view of an example golf club head, consistent with disclosed embodiments.

Referring generally to FIGS. 1 to 4, various embodiments of the disclosure provide a golf club (also referred to herein as a putter) head 100. FIG. 1 is a perspective view of an example head 100, consistent with disclosed embodiments. As shown in FIG. 1, head 100 can have a body 110 with a striking face 120, an upper portion 130 and a lower portion 140 that each extend rearward from the body 110. The body 110 can also include a shaft hole 160 configured to receive a golf club shaft into an upper section of the body. (In this document, "upper" generally refers to sections of the head that are closer to the shaft than the lower portions, which are relatively closer to the ground during use.) As shown in FIG. 4, when a shaft 115 is secured into shaft hole 160, the combination of the shaft 115 and head 100 forms a golf club.

Striking portion 120 serves as the portion for physically striking a golf ball. Optionally, striking portion is a substantially planar surface, but it may have a slight curve or arc in other embodiments. Striking portion can be integral to body 110. In other embodiments, the striking portion 120 can be replaceable (e.g., to change to a different material, replace the surface because of wear and tear, etc.). In such embodiments, striking portion 120 can be removed from body 110 and secured to body 110 by one or more fasteners, clips, or other suitable securing mechanisms.

Head 100 can include an aperture 150 extending through the upper portion 130 and lower portion 140. Aperture 150 extends through the entire head 100 (see FIG. 2 top view and FIG. 3 bottom view). Each of the upper and lower portions includes a respective top surface (i.e., the visible portion of upper portion 130 and lower portion 140 of FIG. 2, respectively) and a bottom surface 190, 200 (as in FIG. 3). The upper portion 130 is shown as having an outer boundary that includes the portion of the body 110 that includes the striking face 120 and an inner boundary that forms a frame around an opening that is larger than the aperture 150. The lower portion 140 is shown as a V-shaped member with a vertex attached to the body of which the striking surface 110 is a part and two arms that extend from the body 110 toward the rear of the club head. The opening between the arms of lower portion 140 overlaps with the opening formed by the inner boundary of the upper portion 130. This area of overlap is the aperture 150 that provides an alignment function as will be described below.

It should be noted that this disclosure is not limited to the specific embodiments shown. For example, the structural elements of upper portion 130 and lower portion 140 can be reversed from that shown in the figures, so that upper portion 130 is generally V-shaped and lower portion 140 frames an opening. In addition, upper portion 130 and lower portion 140 may have shapes other than those shown, so long as the edges of the upper portion 130 and lower portion 140 cooperate to form an aperture 150 that provides an alignment function.

Figure 5A:
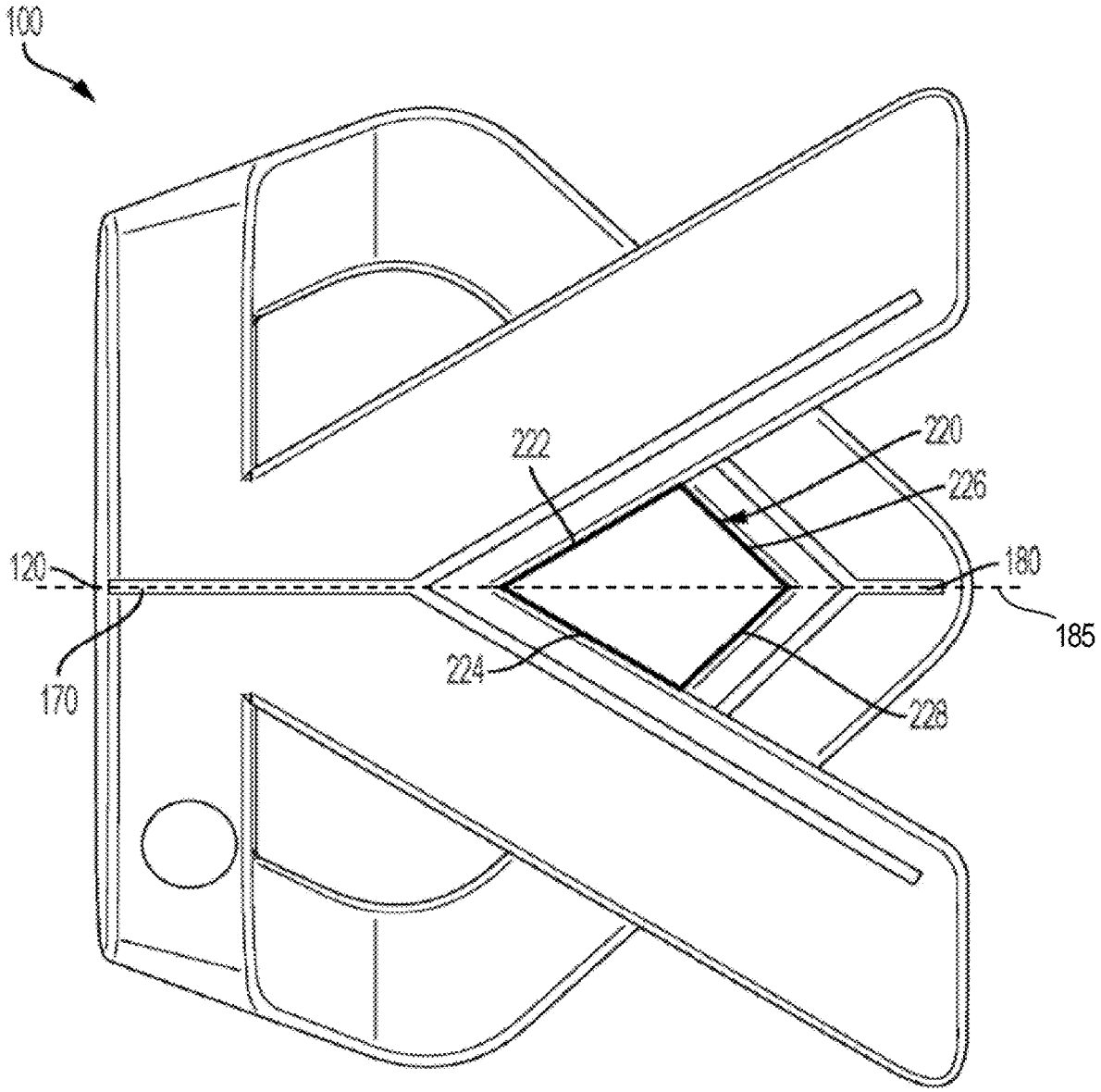
FIG. 5A is an illustration of an example golf club head showing a geometric shape aligning feature in an aligned configuration, consistent with disclosed embodiments.

The aperture 150 is formed by edges of the upper portion 130 and lower portion 140 and has a boundary that is in the form of a geometric shape that the geometric shape is a closed shape that is completely bound by a combination of the upper portion 130 and lower portion 140. The geometric shape can be in the form of a variety of shapes including a diamond, a circle, a rectangle, a square, a triangle, or any other suitable shape. Geometric shape 220 is illustrated as a diamond in the figures. As illustrated by FIG. 5A, geometric shape 220 is symmetric and has two sides 222, 224 formed by upper portion 130 and two sides 226, 228 formed by lower portion 140. Although FIG. 5A shows a shape with four sides, a symmetric shape with any number of sides, including but not limited to hexagons, octagons, and pentagons may be used.

Figure 5B:
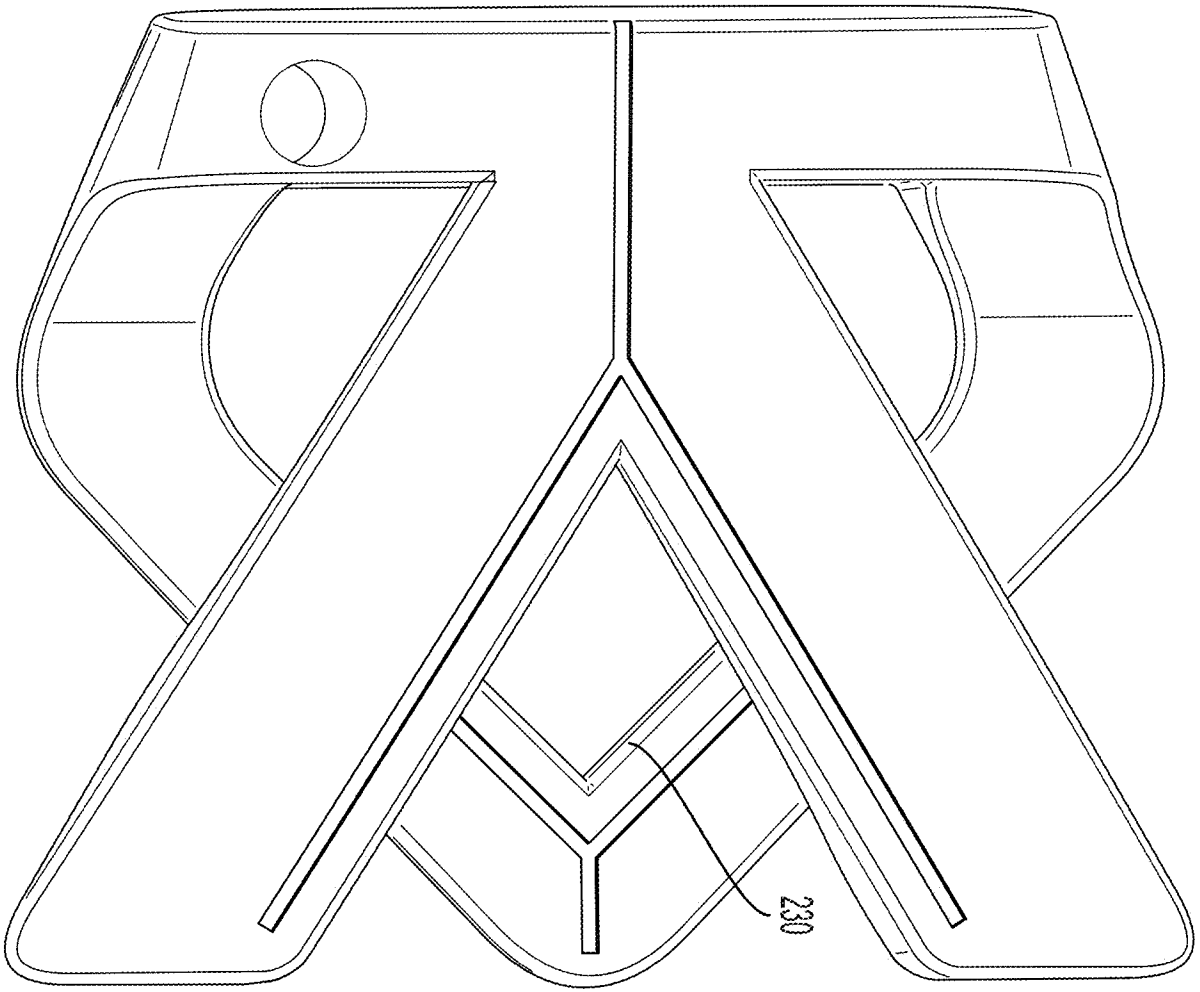
FIG. 5B is an illustration of an example golf club head showing a geometric shape aligning feature in a misaligned configuration, consistent with disclosed embodiments.

FIG. 5A illustrates the head in a properly oriented position with respect to the user of a golf club having head 100. When viewed from directly above, the borders of geometric shape 220 will appear to the player as symmetric. FIG. 5B illustrates the head 100 in a misaligned configuration where the border of geometric shape 230 appears to be deformed and asymmetric to a player whose eyes are positioned directly above the club head. Accordingly, the user can visually recognize this deformation of geometric shape 230 and correct the club orientation until shape is no longer deformed (and appears symmetric). As shown in FIG. 5A, upper portion 130 can have a part of it extending beyond all or a portion of aperture 150 (i.e., in a direction extending away from striking face 120. For example, upper portion 130 can have a part extending beyond the geometric center of the geometric shape 220.

As shown in FIG. 5A, the upper portion 130 optionally may include a first indexing line 170 imprinted on, formed on, or formed into the surface. First indexing line 170 is a line that faces upward during use, that is perpendicular to the face (i.e., the front-facing surface) of the striking surface, and that extends from the striking surface (or a position near the striking surface) toward the aperture 150. Likewise, lower portion 140 can include a second indexing line 180. Second indexing line 180 is a line that faces upward during use, that is perpendicular to the striking surface 120, and that extends from the aperture 150 (or a position near the aperture 150) toward the rear of the club head.

Figure 5C:
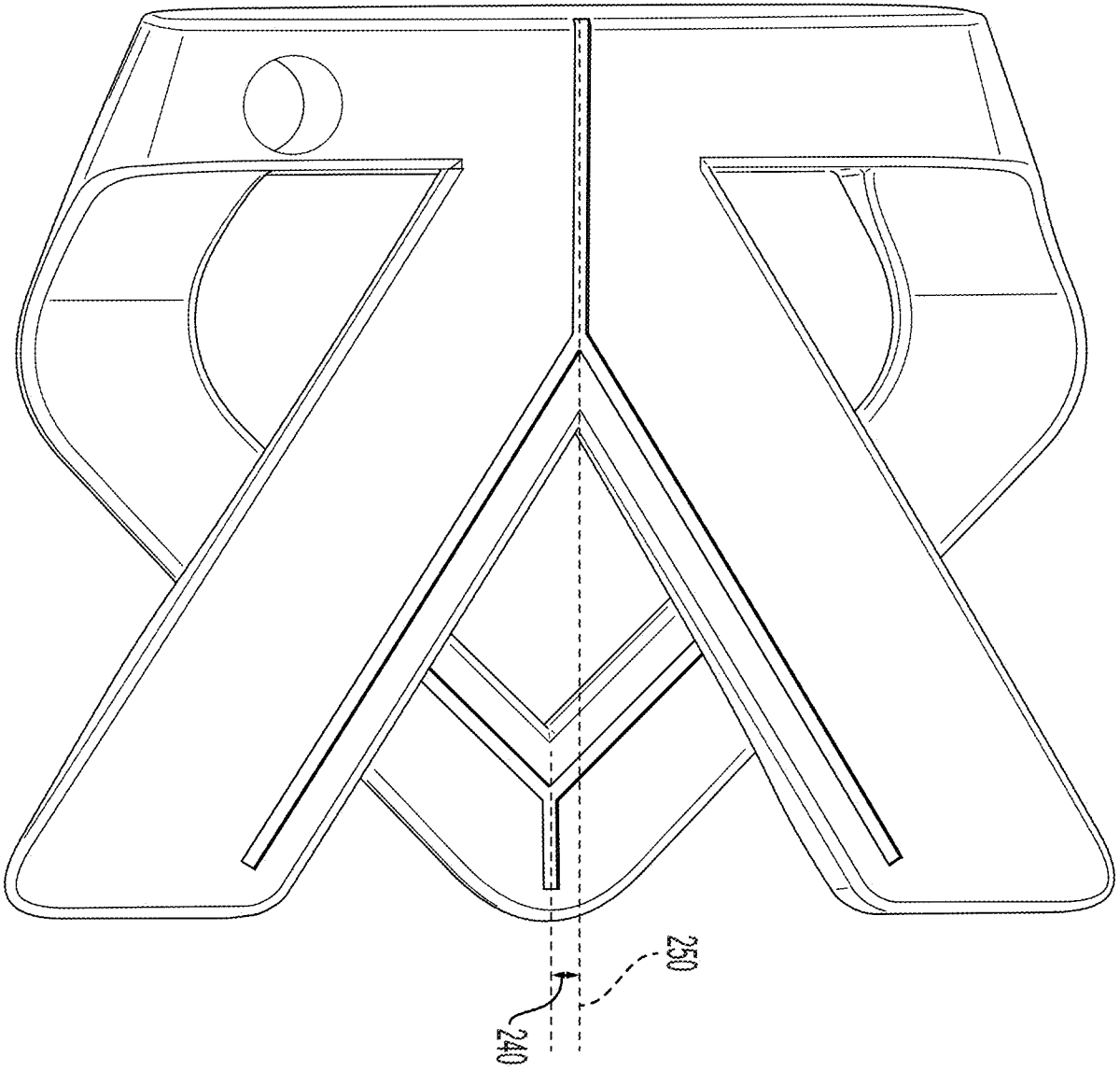
FIG. 5C is an illustration of an example golf club head showing a geometric shape aligning feature in a misaligned configuration, consistent with disclosed embodiments.

When the head is properly oriented (as in FIG. 5A), first indexing line 170 and second portion indexing line 180 will appear to be co-linear to a viewer whose eyes are positioned directly above the club head. Aperture 150 can define a gap between the co-linear first indexing line 170 and second indexing line 180. First indexing line 170 and second indexing line 180 can be co-linear with a centerline 185 (shown, for example, in FIGS. 2 and 5A) of striking portion 120 and/or body 110 and/or aperture 150. For example, first indexing line 170 may bisect the body 110. In other words, first indexing line 170 may be located halfway along a top-facing surface of body 100, for example, along line 250 of FIG. 4C. Geometric shape 220 can also appear to be symmetric about the indexing lines when viewed from above while when the club is properly oriented (see FIG. 5A). When the club is misaligned or and not properly oriented with respect to the ball, the first indexing line 170 and second indexing line 180 appear to be separated by offset 240, as shown in FIG. 5C. Accordingly, the player whose head is positioned above the club head will be able can visually recognize this offset and correct the club head's orientation until the lines are properly aligned (and the geometric shape appears to be symmetric).

Figure 6:
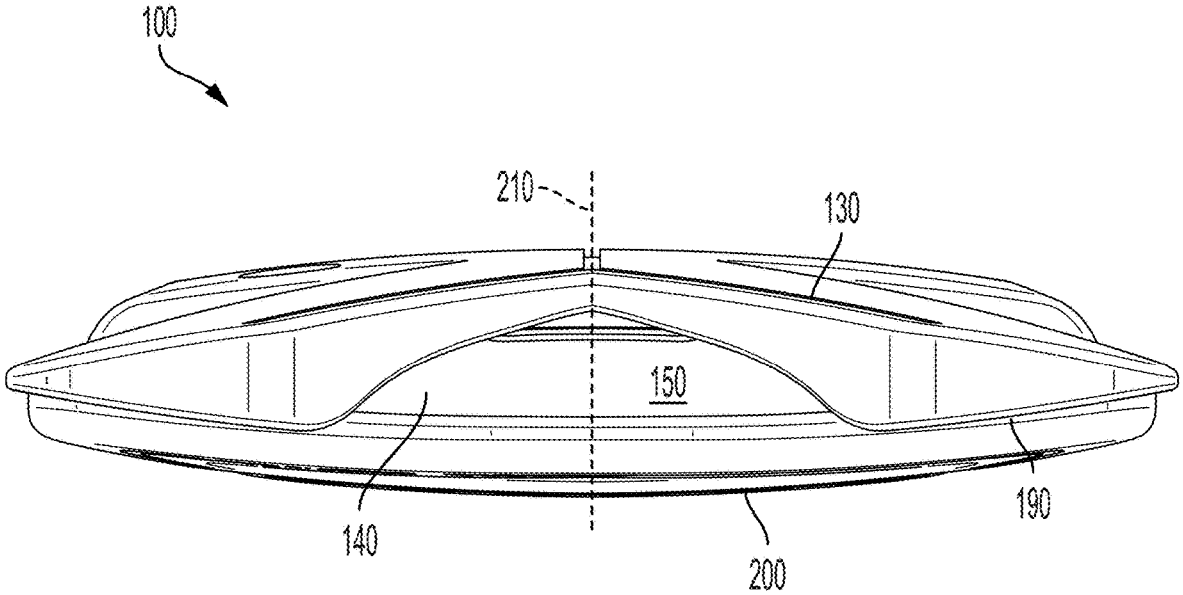
FIG. 6 is a back view of an example golf club head, consistent with disclosed embodiments.

FIG. 6 illustrates a rear view of head 100. As depicted, in at least some areas that do not correspond to the position of aperture 150, a lower surface 190 of upper portion 130 and an upper surface of lower portion 140 contact each other. Alternatively, the upper portion 130 and lower portion 140 may be fully separated by a gap. As depicted, each of the upper portion 130 and lower portion 140 is shaped with symmetrical halves on each side of a vertical centerline 210, although this configuration is also optional.

Figure 7:
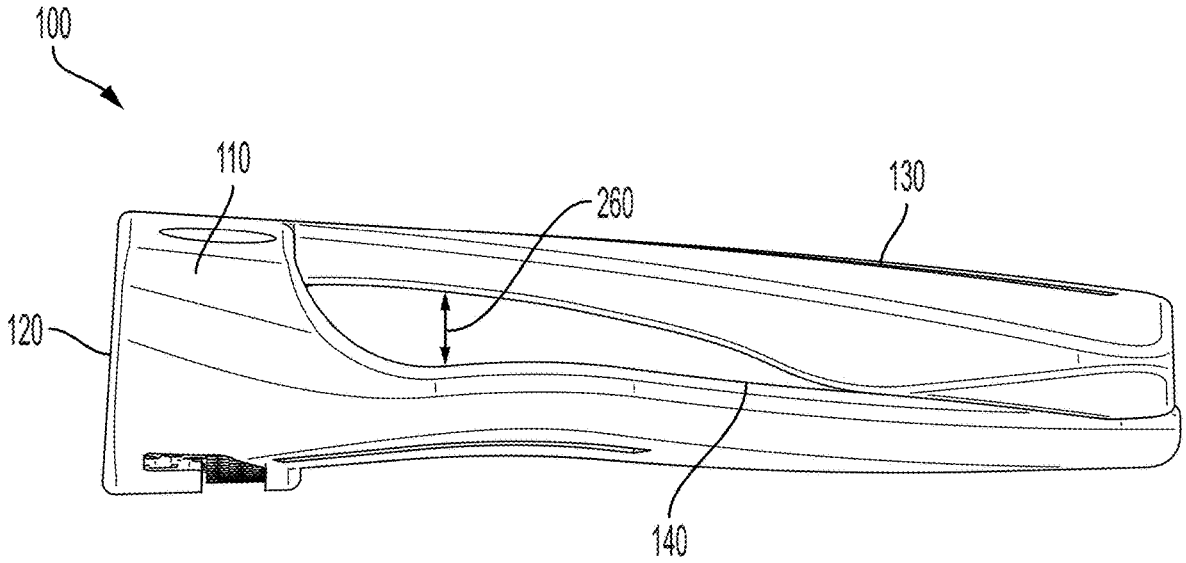
FIG. 7 is a side view of an example golf club head, consistent with disclosed embodiments.

FIG. 7 illustrates a side view of head 100. As depicted, upper portion 130 and lower portion 140 can be cantilevered off of body 110. In some embodiments, the upper portion 130 and lower portion 140 are integral to body 110. In other embodiments, upper portion 130 and lower portion 140 can be separate pieces coupled to body 110. Upper portion 130 and lower portion 140 can be separated by a distance 260. The distance 260, which may vary over the width of head 100, can be sufficient to cause visual deformation of the geometric shape visible to the user when the club is not properly oriented by the user. In some embodiments, the upper portion 130 and lower portion 140 can be fixed relative to one another, for example, with a fastener, standoff, spacer, integrated support, or the like placed between the upper portion 130 and lower portion 140 (e.g., in the gap formed by distance 260). As an example, distance 260 at its greatest point can vary from about 8 mm to about 16 mm. As another example, distance 260 at its greatest point can be about 13 mm.

The golf club head of the present disclosure may be formed of any suitable material, such as bronze, aluminum, brass, copper, zinc, titanium, stainless steel (e.g., 431 stainless steel), a graphite fiber-reinforced epoxy, or any combination of the above.

One or both of the upper portion 130 and lower portion 140 can have an upper surface and/or a lower surface that is substantially perpendicular to striking face 120. Similarly, in some embodiments, each of upper portion 130 and lower portion 140 can have an upper surface and/or lower surface that is substantially parallel to the corresponding surface of the other portion. For example, the upper surfaces of upper portion 130 and lower portion 140 may be substantially parallel to one another.

Figure 8:
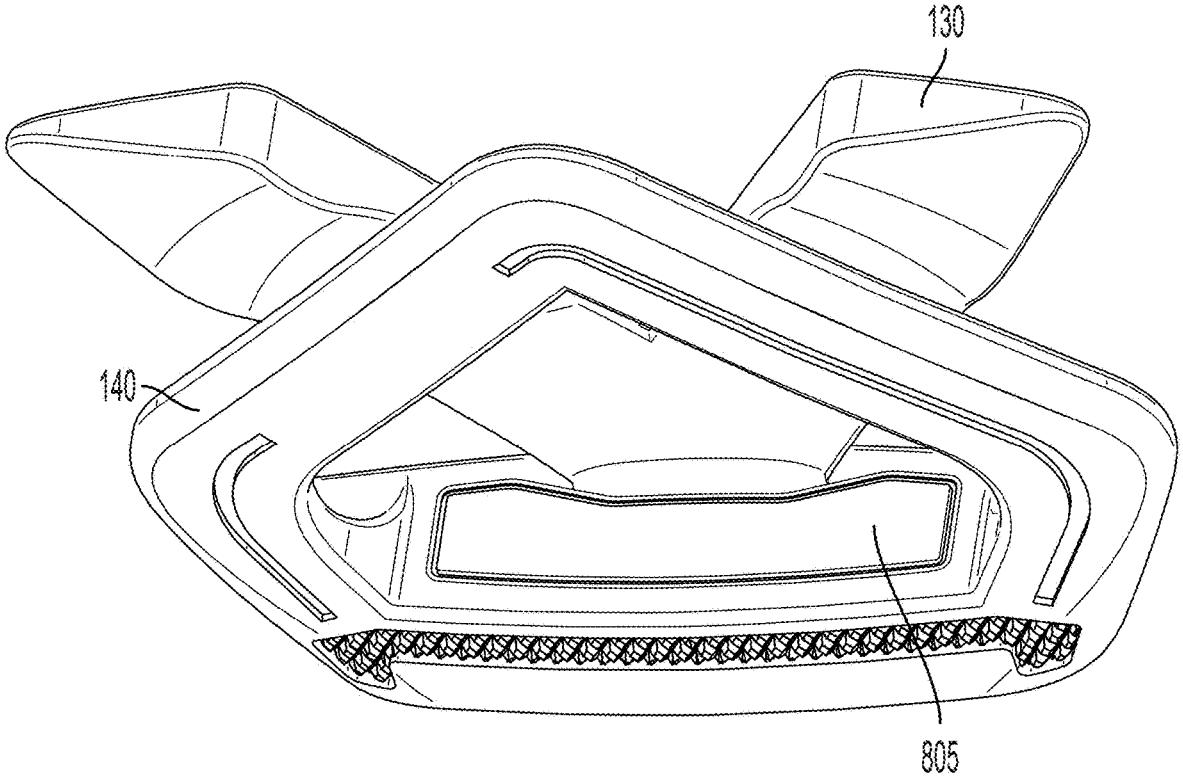
FIG. 8 is a rear back view of an example golf club head, consistent with disclosed embodiments.
Figure 9:
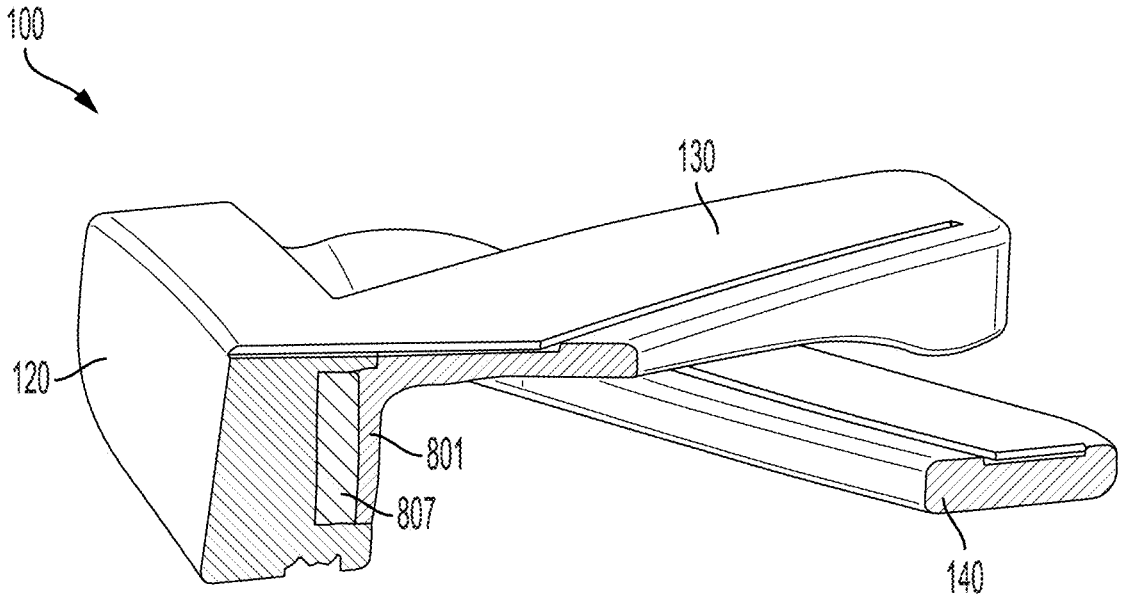
FIG. 9 is cross-sectional perspective view of an example golf club head, consistent with disclosed embodiments.
Figure 10:
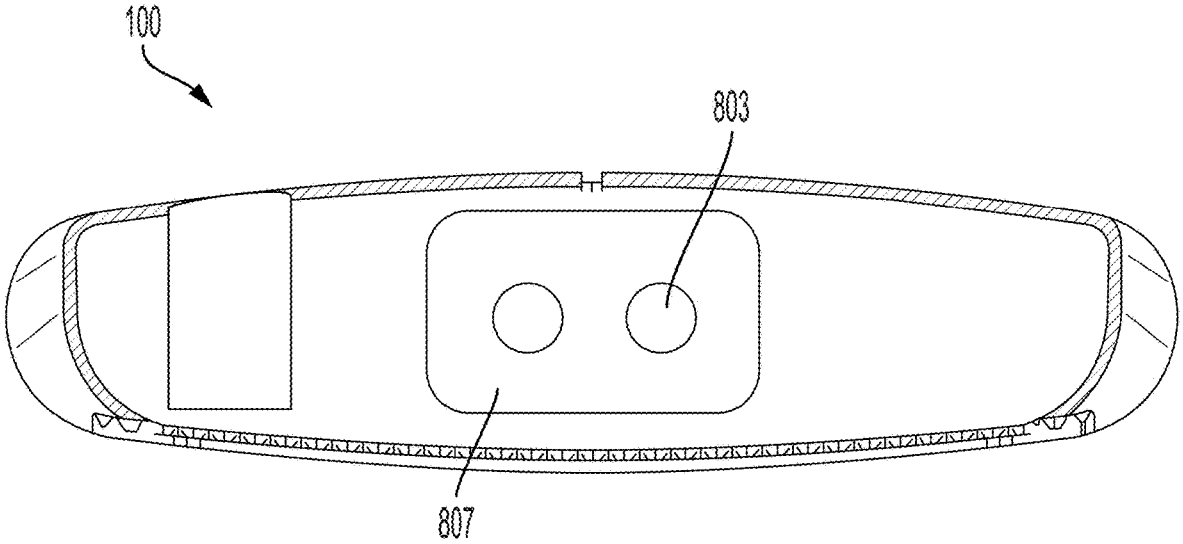
FIG. 10 is a cross-section back view of an example golf club head, consistent with disclosed embodiments.

As explained above, in some embodiments, the head can include multiple pieces that are attached together to form the complete head. For example, as shown in FIGS. 8-10, upper portion 130 can be a separate piece from body 110 and lower portion 140. Upper portion 130 can include an attachment region 801 that is sized and shaped to fit into a corresponding recess in body 110. The putter head can include a cover 805 that is also sized and shaped to fit into the recess. Upper portion 130 can be attached to body 110 using one or more fasteners. The fasteners can be placed in corresponding holes of attachment region 801 and attached to body 110. Cover 805 can be an aesthetic cover plate to hide the one or more fasteners.

To reduce vibration (and associated sound) a spacer 807 can be placed between body 110 and upper portion 130. Spacer 807 can be a flat sheet of material sized and shaped to act as a vibration dampener between body 110 and attachment region 801 of upper portion 130. Spacer 807 can limit or prevent vibration transfer (and resulting resonance in the upper portion 130) from body 110 to upper portion 130 when the putter head strikes a ball. Spacer 807 can be made from a suitable vibration absorbing material, such as rubber, foam (such as a foam tape), silicone, or other suitable material. Spacer 807 can include one or more holes 803 to permit fasteners to pass through and engage body 110 to secure upper portion 130. Spacer 807 can have a thickness of about 1 mm to about 2 mm.

The foregoing merely illustrates the principles of the disclosure. Any examples set forth in this specification are not intended to be limiting and merely set forth some of the many possible embodiments for the appended claims. Those skilled in the art will readily recognize various modifications and changes that may be made without following the example embodiments and applications illustrated and described herein, and without departing from the true spirit and scope of the following claims.

The invention claimed is:

1. A golf club head, comprising:

a body comprising a striking face that faces a front direction, wherein the body defines a centerline that extends in a direction perpendicular to the striking face; and a plurality of elements that extend from the body toward a rear direction, the plurality of elements comprising a first portion and a second portion, wherein:

the first portion comprises an outer boundary;

the second portion comprises a first arm and a second arm, the first arm and the second arm coupled to the body at a vertex, wherein the first arm and the second arm extend in the rear direction so that the first arm and the second arm extend past the outer boundary of the first portion; wherein:

the first portion and the second portion each at least in part form an aperture having a boundary with a geometric shape that is symmetric about the centerline;

the second portion is positioned above the first portion, when the golf club head is located on a ground surface at address;

the aperture extends through the first portion and the second portion; and a first part of the boundary of the aperture is formed by the first portion, and a second part of the boundary of the aperture is formed by the second portion.

2. The golf club head of claim 1, wherein the boundary is a closed boundary.

3. The golf club head of claim 1, wherein:

the first portion includes a first indexing line;

the second portion includes a second indexing line; and each of the first and second indexing lines are perpendicular to the striking face of the body and are co-linear when viewed from a position directly above the golf club head.

4. The golf club head of claim 3, wherein, moving in a direction along the centerline, the aperture is arranged between the co-linear first and second indexing lines.

5. The golf club head of claim 1, wherein the first portion and the second portion are cantilevered off the body.

6. The golf club head of claim 1, wherein the first portion and the second portion are at least partially separated by a gap.

7. The golf club head of claim 1, wherein the first portion and the second portion are at least partially fixed relative to one another by at least one of: a fastener, a spacer, or an integrated support.

8. The golf club head of claim 1, wherein at least one of the first portion or the second portion has a surface that is substantially perpendicular to the striking face.

9. The golf club head of claim 1, wherein the geometric shape has at least four sides.

10. The golf club head of claim 9, wherein a first part of the geometric shape includes a first set of two of the at least four sides and a second part of the geometric shape includes a second set of two of the at least four sides.

11. The golf club head of claim 1, wherein the geometric shape is a diamond.

12. A golf club comprising:

a shaft; and a club head that is connected to the shaft and that comprises:

a body comprising a striking face that faces a front direction, wherein the body defines a centerline that extends in a direction perpendicular to the striking face; and a plurality of elements that extend from the body toward a rear direction, the plurality of elements comprising a first portion and a second portion, wherein:

the first portion comprises an outer boundary;

the second portion comprises a first arm and a second arm, the first arm and the second arm coupled to the body at a vertex, wherein the first arm and the second arm extend in the rear direction so that the first arm and the second arm extend past the outer boundary of the first portion; wherein:

the first portion and the second portion each at least in part form an aperture having a boundary with a geometric shape that is symmetric about the centerline;

the second portion is positioned above the first portion, when the club head is located on a ground surface at address;

the aperture extends through the first portion and the second portion; and a first part of the boundary of the aperture is formed by the first portion, and a second part of the boundary of the aperture is formed by the second portion.

13. The golf club of claim 12, wherein:

the first portion includes a first indexing line;

the second portion includes a second indexing line; and each of the first and second indexing lines are perpendicular to the striking face of the body and are co-linear when viewed from a position directly above the golf club head.

14. The golf club of claim 13, wherein, moving in a direction along the centerline, the aperture is arranged between the co-linear first and second indexing lines.

15. The golf club of claim 12, wherein the first portion and the second portion are cantilevered off the body.

16. The golf club of claim 12, wherein the first portion and the second portion are at least partially separated by a gap.

17. The golf club of claim 12 wherein at least one of the first portion or the second portion has a surface that is substantially perpendicular to the striking face.

18. The golf club of claim 12, wherein the geometric shape is a diamond.

* * * * *